US007275915B2

(12) United States Patent
Liao

(10) Patent No.: US 7,275,915 B2
(45) Date of Patent: Oct. 2, 2007

(54) REINFORCED CEILING FAN BLADE

(76) Inventor: Hsien-Ming Liao, No. 11, Lane 313, Fonglin St., Daya Township, Taichung County 428 (TW)

( * ) Notice: Subject to any disclaimer, the term of this patent is extended or adjusted under 35 U.S.C. 154(b) by 132 days.

(21) Appl. No.: 11/264,839

(22) Filed: Nov. 1, 2005

(65) Prior Publication Data

US 2007/0098560 A1 May 3, 2007

(51) Int. Cl.
*F04D 29/34* (2006.01)
*F01D 5/00* (2006.01)

(52) U.S. Cl. ..... 416/210 R; 416/5; 416/229 R

(58) Field of Classification Search ..... 416/210 R, 416/229 R, 5

See application file for complete search history.

(56) References Cited

U.S. PATENT DOCUMENTS

| | | | | |
|---|---|---|---|---|
| 1,763,218 | A * | 6/1930 | Caldwell | 416/229 R |
| 2,589,316 | A * | 3/1952 | Young | 416/229 R |
| 4,022,547 | A * | 5/1977 | Stanley | 416/230 |
| 4,627,791 | A * | 12/1986 | Marshall | 416/132 R |
| 6,890,155 | B2 * | 5/2005 | Cartwright | 416/229 R |

* cited by examiner

*Primary Examiner*—Igor Kershteyn
(74) *Attorney, Agent, or Firm*—Charles E. Baxley

(57) ABSTRACT

A reinforced ceiling fan blade in accordance with the present invention comprises an upper half fan blade and a lower half fan blade. The upper half fan blade includes a plurality of wood sheets. The lower half fan blade includes a plurality of wood sheets, and the upper half fan blade is laminated on the lower half fan blade in such a manner that abutting sides of the upper half fan blade are staggered with respect to abutting sides of the lower half fan blade, so that the strength of the ceiling fan blade can be improved.

2 Claims, 5 Drawing Sheets

REINFORCED CEILING FAN BLADE

BACKGROUND OF THE INVENTION

1. Field of the Invention

The present invention relates to a ceiling fan blade, and more particularly to a reinforced ceiling fan blade.

2. Description of the Prior Art

Ceiling fan blades are made of various materials, and wood ceiling fan blade is more popular due to its light weight and low cost.

Referring to FIG. 1, which shows a conventional wood ceiling fan blade 1 comprising a plurality of wood sheets 10. The abutting side 11 of the respective wood sheets 10 is coated with adhesive agent, and then the respective wood sheets 10 are connected to one another by high pressure processing, and finally a wood ceiling fan blade is finish by treating the wood sheets with planning machine.

However, one of the drawbacks of this conventional wood ceiling fan blade is that it is made of only a layer of wood sheets 10, therefore the structure of this wood ceiling fan blade is too weak and is liable to be broken after being subjected to an external force.

The present invention has arisen to mitigate and/or obviate the afore-described disadvantages.

SUMMARY OF THE INVENTION

The primary objective of the present invention is to provide a reinforced ceiling fan blade with strengthened structure.

The secondary objective of the present invention is to provide a reinforced ceiling fan blade that is low cost.

A reinforced ceiling fan blade in accordance with the present invention comprises an upper half fan blade and a lower half fan blade. The upper half fan blade includes a plurality of wood sheets. The lower half fan blade includes a plurality of wood sheets, and the upper half fan blade is laminated on the lower half fan blade in such a manner that abutting sides of the upper half fan blade are staggered with respect to abutting sides of the lower half fan blade.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
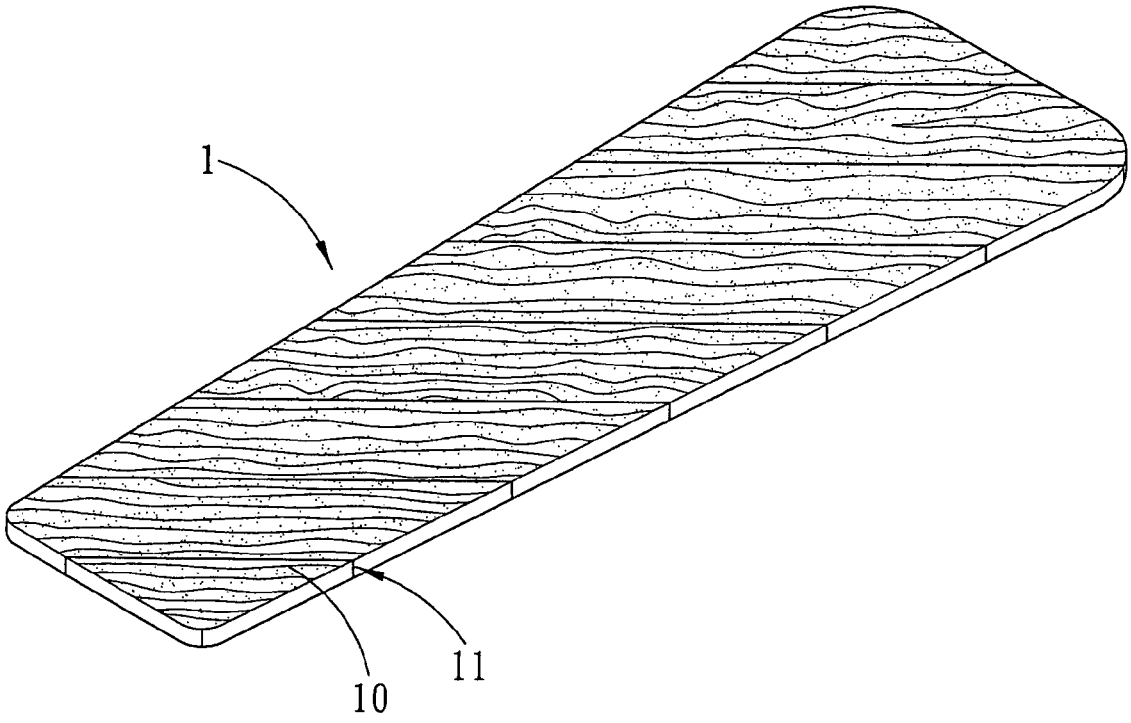
FIG. 1 PRIOR ART
FIG. 1 shows a conventional wood ceiling fan blade.
Figure 2:
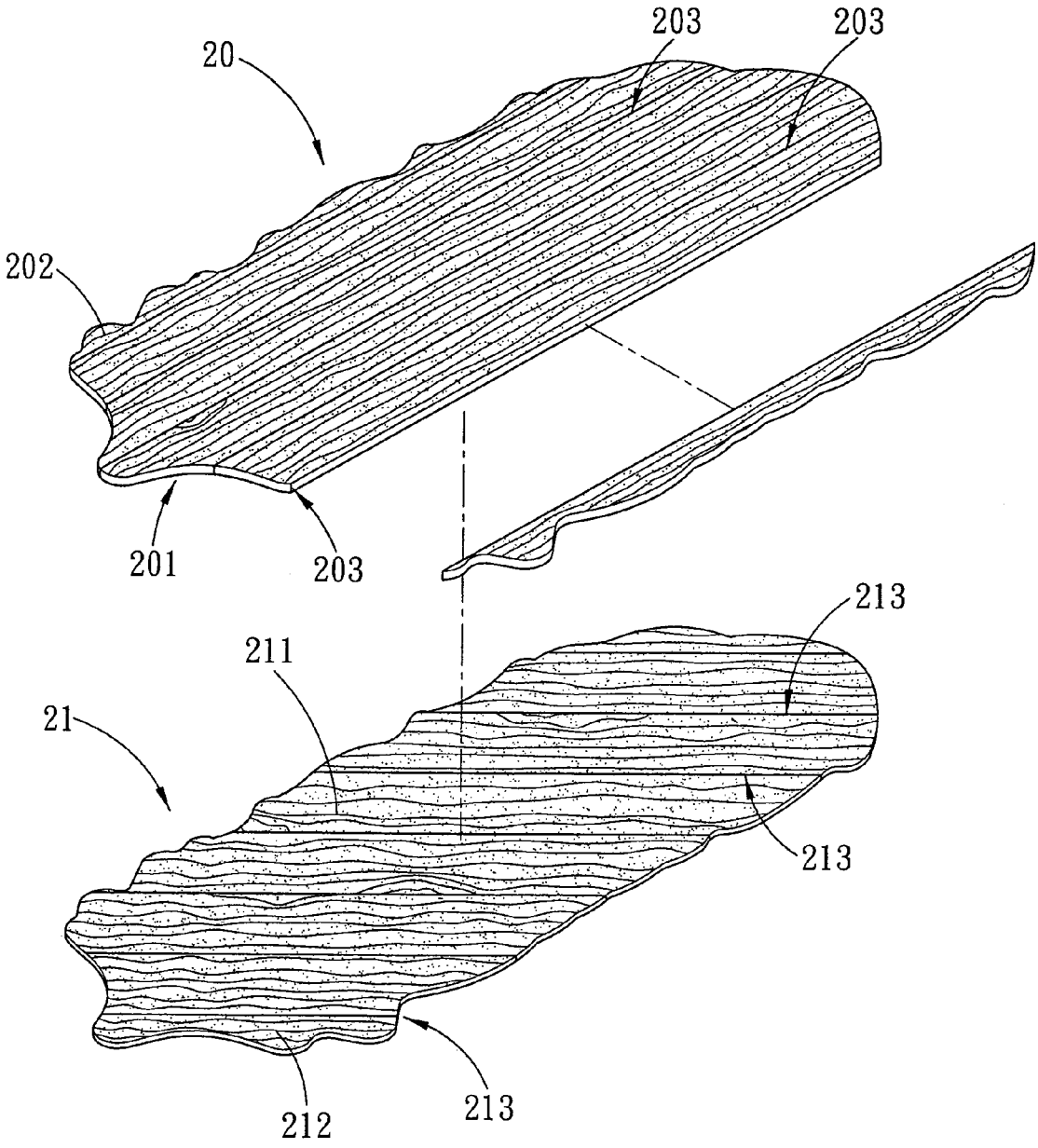
FIG. 2 is an exploded view of a reinforced wood ceiling fan blade in accordance with the present invention.
Figure 3:
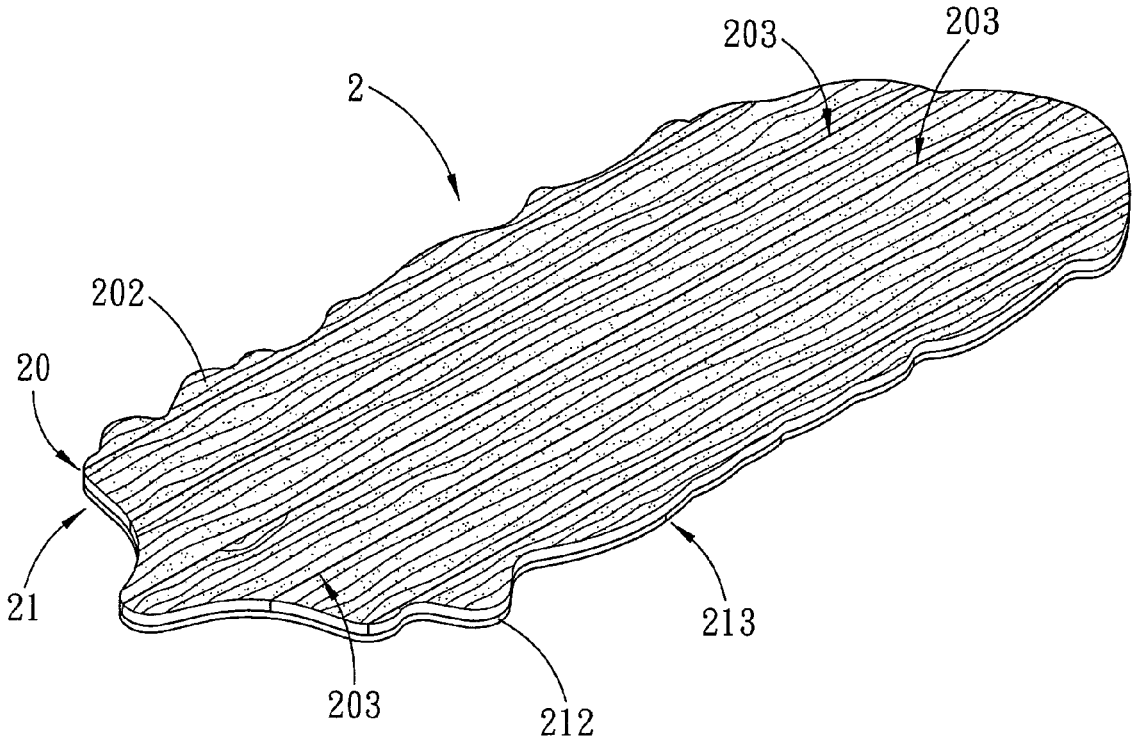
FIG. 3 is a perspective view of the reinforced wood ceiling fan blade of FIG. 2.

Referring to FIGS. 2 and 3, a reinforced wood ceiling fan blade 2 in accordance with the present invention is shown and comprises an upper half fan blade 20 and a lower half fan blade 21. The upper half fan blade 20 includes a plurality of wood sheets 202, and abutting sides 203 of the wood sheets 202 are coated with adhesive agent and then are connected to one another by hot pressing. The lower half fan blade 21 also includes a plurality of wood sheets 212, and abutting sides 213 of the wood sheets 212 are coated with adhesive agent and then are connected to one another by hot pressing. The upper half fan blade 20 and the lower half fan blade 21 are bonded together by hot pressing. The abutting sides 203 of the upper half fan blade 20 are arranged in a staggered manner with respect to the abutting sides 213 of the lower half fan blade 21, that is, the wood sheets 202 of the upper half fan blade 20 are staggered with respect to the wood sheets 212 of the lower half fan blade 21, so as to improve the strength of the wood ceiling fan blade 2.

Figure 4:
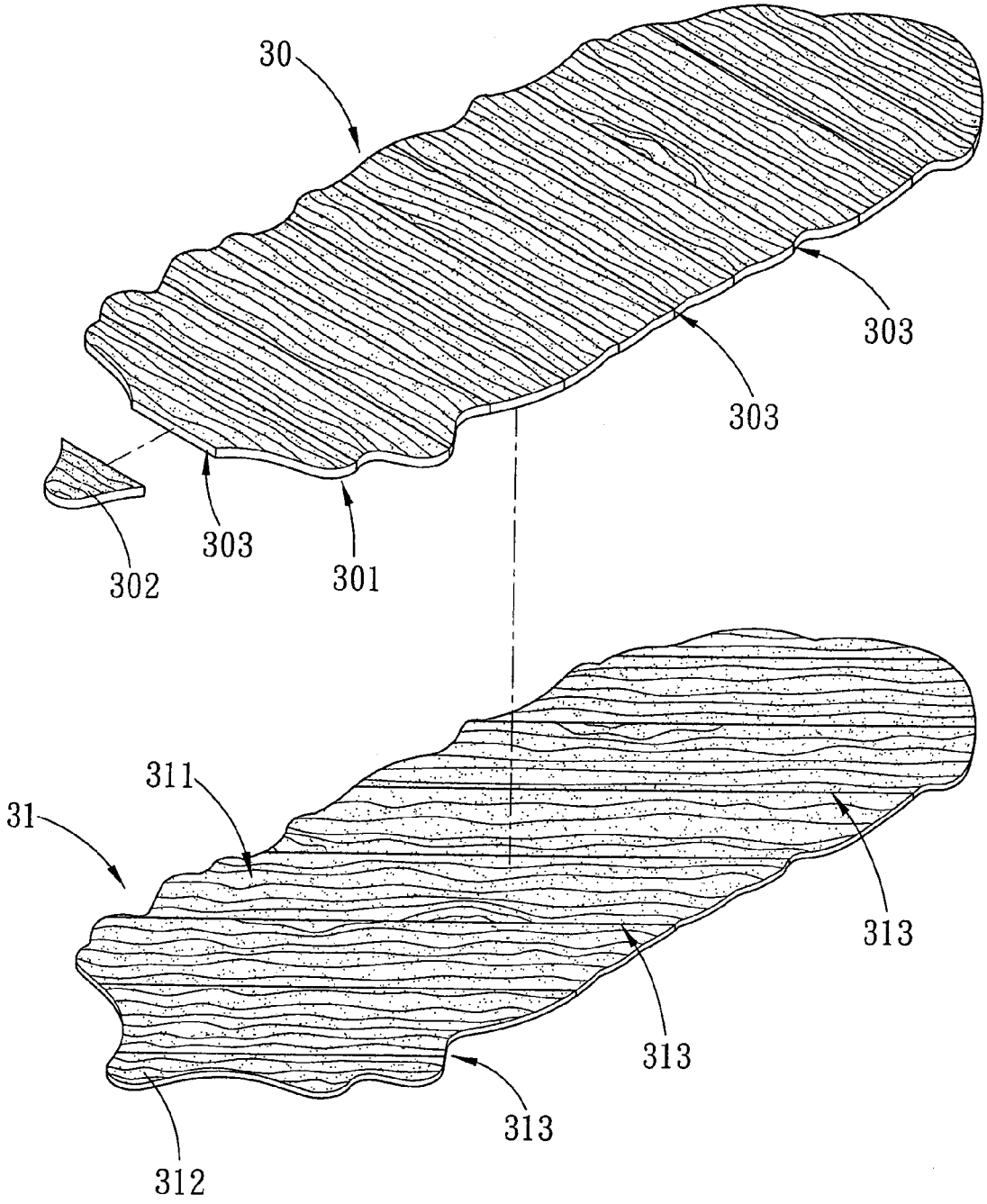
FIG. 4 is an exploded view of a reinforced wood ceiling fan blade in accordance with another embodiment of the present invention.
Figure 5:
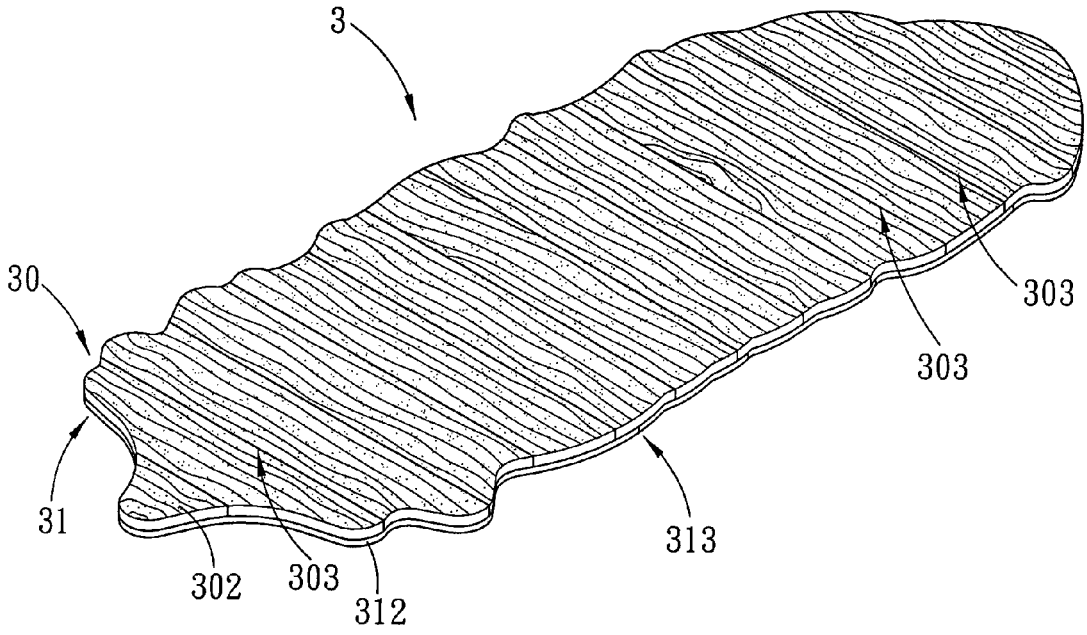
FIG. 5 is a perspective view of the reinforced wood ceiling fan blade of FIG. 4.

Referring to FIGS. 4 and 5, a reinforced wood ceiling fan blade in accordance with another embodiment of the present invention is similar to that of the previous embodiment, except that: the abutting sides 303 of the upper half fan blade 30 are connected in a different direction as compared to the previous embodiment.

While we have shown and described various embodiments in accordance with the present invention, it should be clear to those skilled in the art that further embodiments may be made without departing from the scope of the present invention.

What is claimed is:

1. A reinforced ceiling fan blade comprising an upper half fan blade and a lower half fan blade; wherein the upper half fan blade includes a plurality of wood sheets; and the lower half fan blade includes a plurality of wood sheets, the upper half fan blade is laminated on the lower half fan blade in such a manner that abutting sides of the upper half fan blade are staggered with respect to abutting sides of the lower half fan blade.

2. The reinforced ceiling fan blade as claimed in claim 1, wherein the upper half fan blade is glued to the lower half fan blade by hot pressing.

* * * * *